US005701543A

United States Patent [19]

Arimoto

[11] Patent Number: 5,701,543

[45] Date of Patent: Dec. 23, 1997

[54] CARTRIDGE CASE STOCKER APPARATUS IN AUTOMATIC FILM DEVELOPMENT PROCESSOR MACHINE

[75] Inventor: Keigo Arimoto, Wakayama, Japan

[73] Assignee: Noritsu Koki Co., Ltd., Wakayama, Japan

[21] Appl. No.: 713,029

[22] Filed: Sep. 12, 1996

[30] Foreign Application Priority Data

Sep. 19, 1995 [JP] Japan ..... 7-240124

[51] Int. Cl.[6] ..... G03D 3/08

[52] U.S. Cl. ..... 396/620

[58] Field of Search ..... 396/612, 617, 396/620, 512; 198/409, 468.6, 346; 352/72, 78 R; 414/331, 227, 796, 786, 795.4, 280

[56] References Cited

U.S. PATENT DOCUMENTS 4,113,366 9/1978 Glover ..... 352/123

4,797,698 1/1989 Uenaka et al. ..... 396/612

5,541,699 7/1996 Yamaguchi ..... 396/620

FOREIGN PATENT DOCUMENTS 7-281386 10/1995 Japan .

*Primary Examiner*—D. Rutledge

*Attorney, Agent, or Firm*—Wenderoth, Lind & Ponack

[57] ABSTRACT

A cartridge case stocker apparatus for use in an automatic film development processor machine comprises a pair of lifting devices movably arranged opposite to each other to have a space therebetween for detachably storing a number of cartridge cases and driven by a drive device; and rows of support plates mounted at substantially equal intervals to the lifting devices for engaging with and holding the two edges of each cartridge case with a corresponding pair thereof.

4 Claims, 7 Drawing Sheets

CARTRIDGE CASE STOCKER APPARATUS IN AUTOMATIC FILM DEVELOPMENT PROCESSOR MACHINE

BACKGROUND OF THE INVENTION

The present invention relates to an apparatus for storing a number of film cartridges loaded with photographic films in a film development processor machine.

A photographic film development processor machine for subjecting sheets of undeveloped film to a series of common processes including development, fixing, and drying is known as proposed by the same applicants and filed in Japanese Patent Application No. 6-75561 (1994).

In the film development processor machine, a cartridge case of a box shape filled with a group of film cartridges is installed to a given station and the film cartridges are released one by one from the cartridge case. A sheet of undeveloped film is then unloaded from its cartridge and joined with a film leader by a strip of adhesive tape before being subjected to the development, bleaching, fixing, stabilizing, drying, and other relevant steps of the development procedure. After the development procedure is completed, a resultant developed form of the film sheet is loaded back to its film cartridge.

Such a conventional film development processor machine allows each box-shaped cartridge case carrying the group of the film cartridges to be manually installed to the given station by an operator of the machine. The action of the machine should be monitored time to time so that the unloading of the undeveloped film sheets is continuously carried out without unwanted interruption, and the cartridge case upon being exhausted should be replaced with an undeveloped film loaded one without delay. Accordingly, the development process stays demanding and will be declined in the efficiency.

Particularly, a advanced type of the automatic film development processor machine requires more frequent replacement of the unloaded cartridge case with a loaded one, whereby the above drawback will be emphasized.

The present invention is developed for eliminating the above drawback and its object is to provide a carriage case stocker apparatus which allows the exchange of the cartridge case filled with the cartridges to be carried out at less frequency thus increasing the operational efficiency.

SUMMARY OF THE INVENTION

For achievement of the object of the present invention, a cartridge case stocker apparatus for use in an automatic film development processor machine is provided comprising a pair of lifting devices movably arranged opposite to each other to have a space therebetween for detachably storing a number of cartridge cases and driven by a drive device, and rows of support plates mounted at substantially equal intervals to the lifting devices for engaging with and holding the two edges of each cartridge case with a corresponding pair thereof.

The drive device may be arranged for forward and backward movements so that the cartridge cases held with the support plates of the two opposite lifting devices can be lifted up and down for temporal storage. Also, the apparatus may further include a cartridge case conveying means disposed beneath the lifting devices thus to cooperate partially with the lifting devices for transferring the cartridge cases between the cartridge case conveying means and the lifting devices.

According to the present invention, the lifting device may be composed of either a loop of chain, belt, or the like.

DETAILED DESCRIPTION OF THE PREFERRED EMBODIMENT

A cartridge case stocker apparatus according to the present invention is located in an unloading station for unloading and feeding sheets of undeveloped film to an automatic film development processor machine. A group of cartridge cases are supplied in the cartridge case stocker apparatus so that their peripheral edges are supported as engaged with corresponding support plates of two opposite lifting devices of the stocker apparatus.

The cartridge cases held in the stocker apparatus are lifted down one by one to the unloading station where the undeveloped film sheets are unloaded in a succession from their respective film cartridges in the cartridge case for the development process.

When the undeveloped film sheets have completely been unloaded from their respective cartridges in the cartridge case, the film unloaded cartridge case is conveyed and departed from the unloading station by a conveying means. Then, the succeeding cartridge case is lifted down to the unloading station by the action of the lifting devices controlled with a drive device, and another series of the undeveloped film sheets are unloaded from the film cartridges in the succeeding cartridge case without any interval of time.

The cartridge case stocker apparatus of the present invention may also be located at a loading station of the automatic film development processor machine where sheets of developed film are loaded again in a succession into their respective film cartridges in the cartridge case which has been conveyed from the unloading station.

Upon the developed film sheets having been loaded into their respective cartridges, the cartridge case is lifted up by the loop movement of the lifting devices controlled with the drive device for storage in the cartridge case stocker apparatus.

As the film loaded cartridge case is lifted up, the succeeding cartridge case unloaded with films is conveyed to the loading station and the loading of developed film sheets into their respective film cartridges is repeated.

Embodiment

The cartridge case stocker apparatus of the present invention in an automatic film development processor machine will be described in more details referring to the accompanying drawings.

Figure 1:
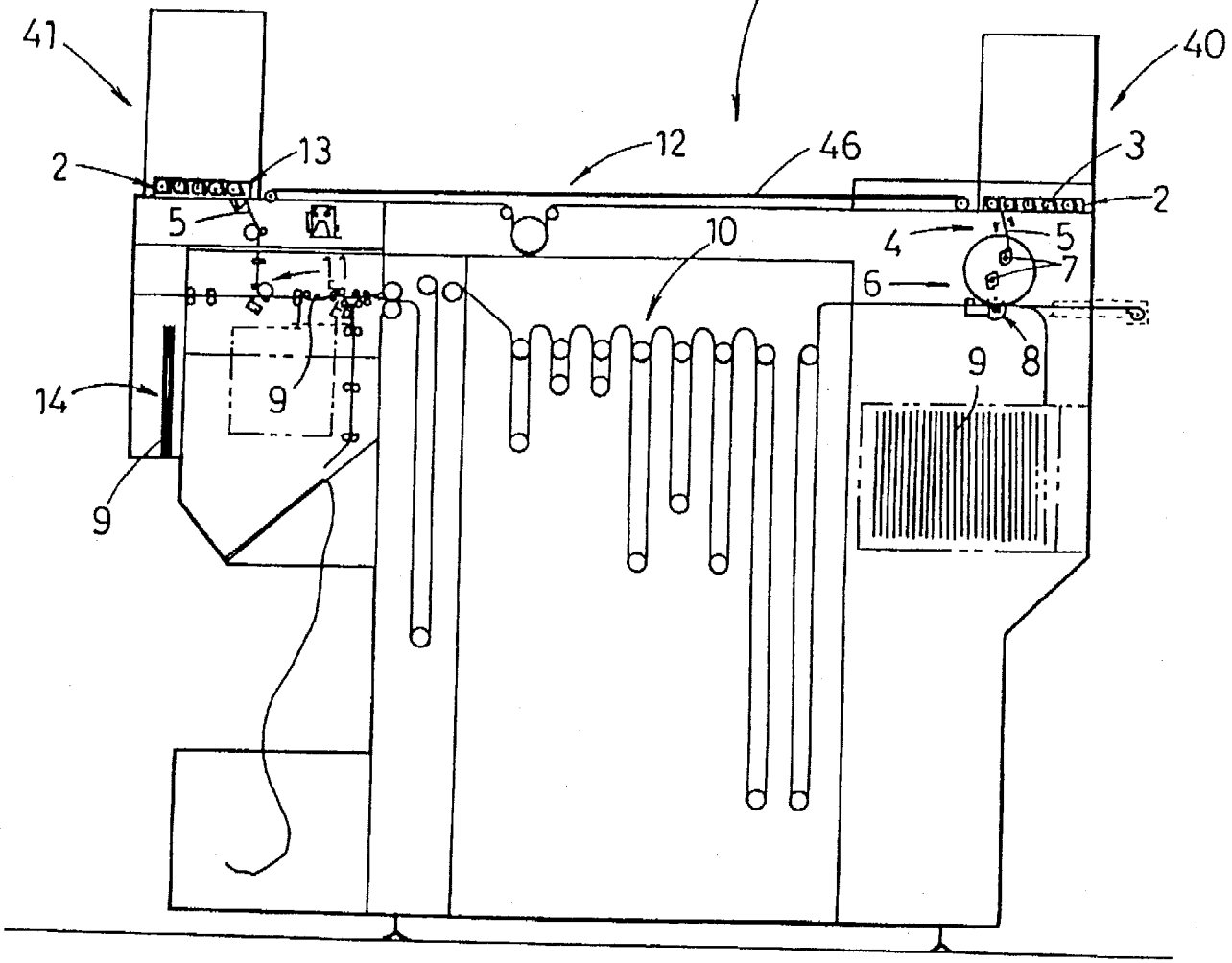
FIG. 1 is a schematic side view of a automatic film development processor machine.

FIG. 1 schematically illustrates the automatic film development processor machine in which its entire installation is denoted by the numeral 1.

Also shown are a cartridge case 2 for carrying therein a number of film cartridges 3 loaded with undeveloped film, an unloading station 4 where a sheet of undeveloped film 5 is drawn out from its cartridge 3, and a rewinding station 6 where the undeveloped film sheet 5 is rewound into a takeup cartridge 7.

There are provided a splicer unit 8 for joining the leading end of the undeveloped film sheet 5 with a short film leader 9 for further transferring, a developer unit 10 for developing the undeveloped film sheet 5 accompanied with the short leader 9, a separator unit 11 for separating the developed film sheet 5 from the short leader 9, an unloaded film cartridge conveyer means 12 for conveying the unloaded film cartridge 3 from which the undeveloped film sheet 5 has been unloaded at the unloading station 4, a loading station 13 where a developed film sheet 5 is loaded into the unloaded film cartridge 3, and a leader receiver unit 14 for storing a group of the short leaders 9 separated from their respective developed film sheets 5 at the separator unit 11.

Denoted by 40 and 41 are the stock apparatuses which are substantially identical in construction to each other for storing the cartridge cases 2. The stock apparatus 40 is located at the unloading station 4 (a feeder of undeveloped film) where each undeveloped film sheet 5 is unloaded from its cartridge 3, and the stock apparatus 41 is located at the loading station 13 where each developed film sheet 5 is loaded into a corresponding cartridge 3.

Figure 2:
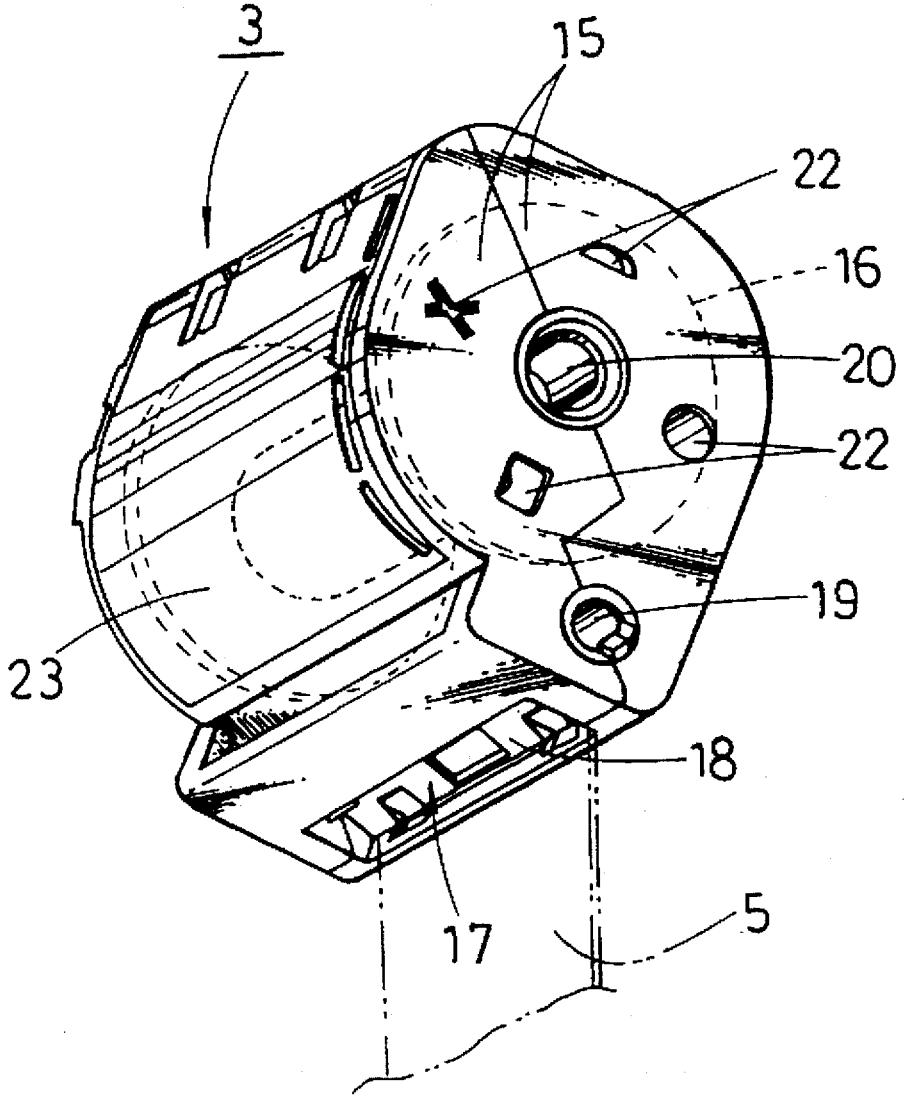
FIG. 2 is a perspective view of a film cartridge to be placed in a cartridge case.
Figure 3:
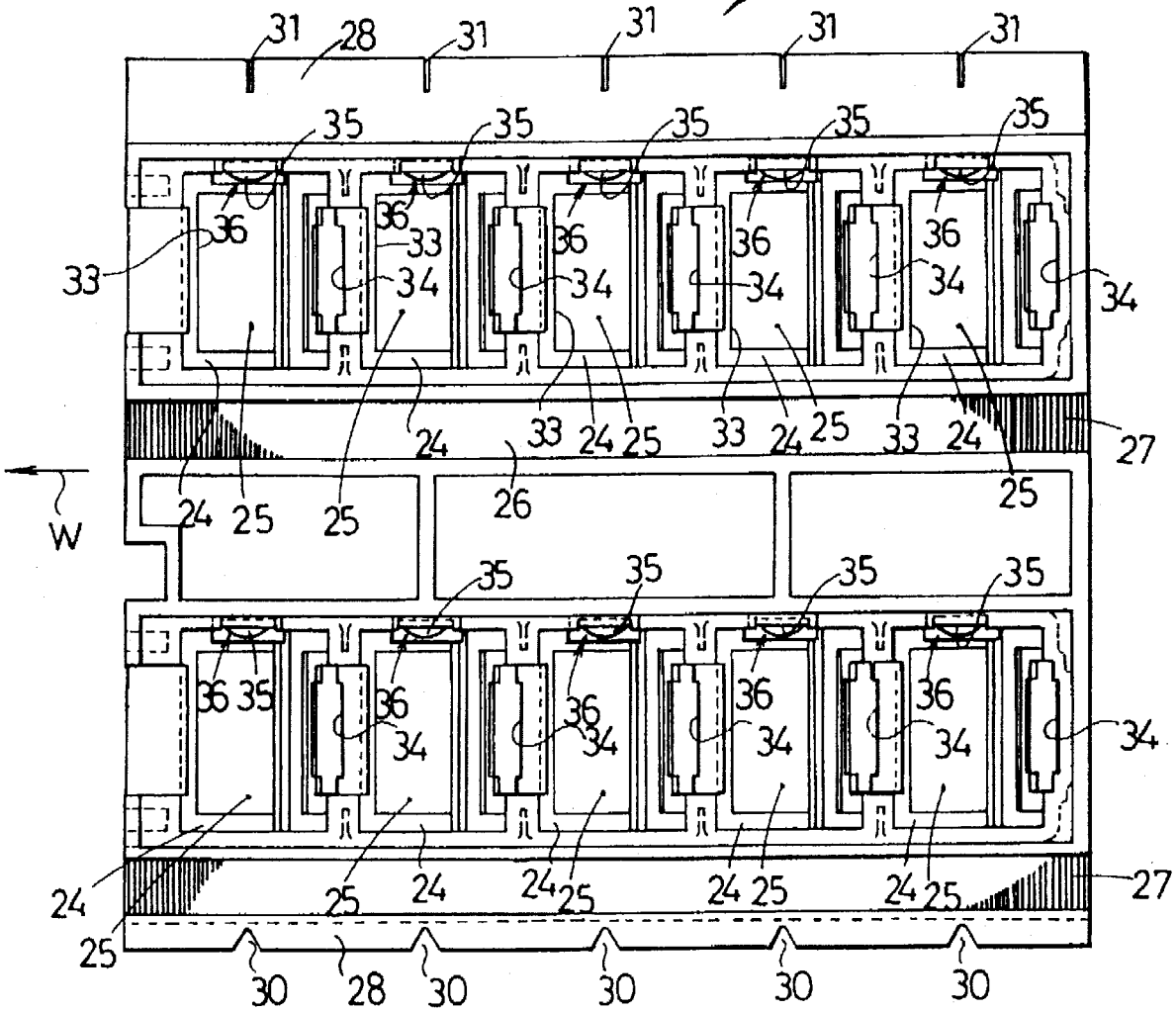
FIG. 3 is a plan view of the cartridge case.
Figure 4:
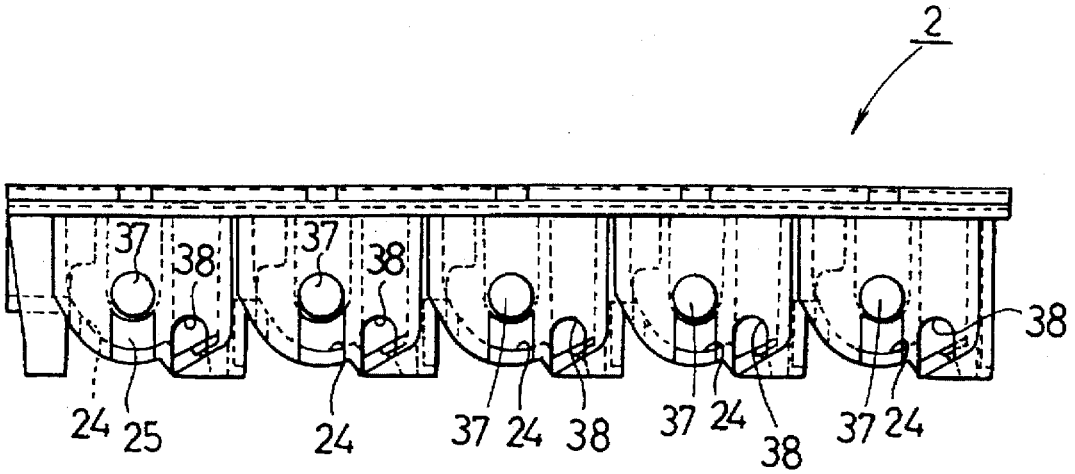
FIG. 4 is a side view of the cartridge case.
Figure 5:
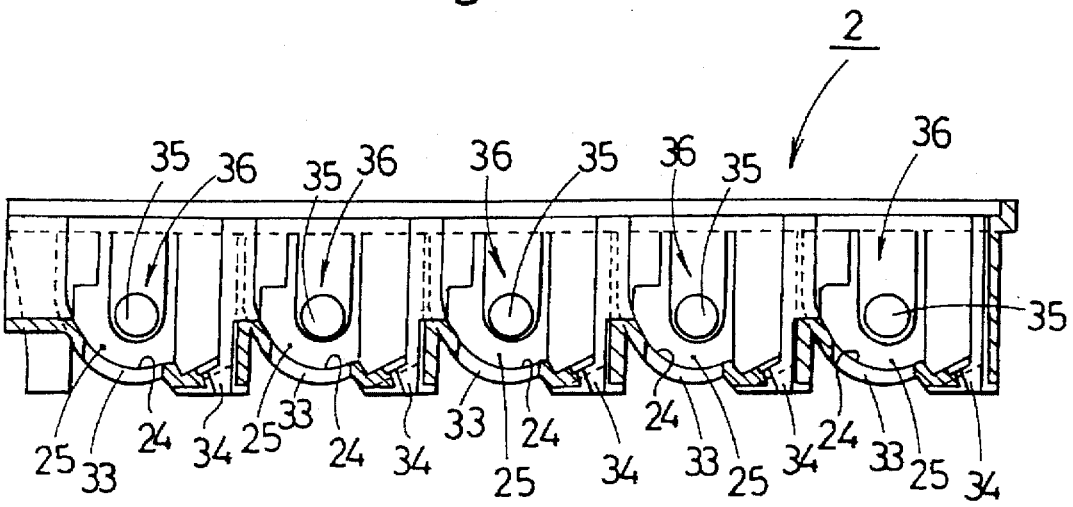
FIG. 5 is a longitudinally cross sectional view of cartridge containers of the cartridge case.
Figure 6:
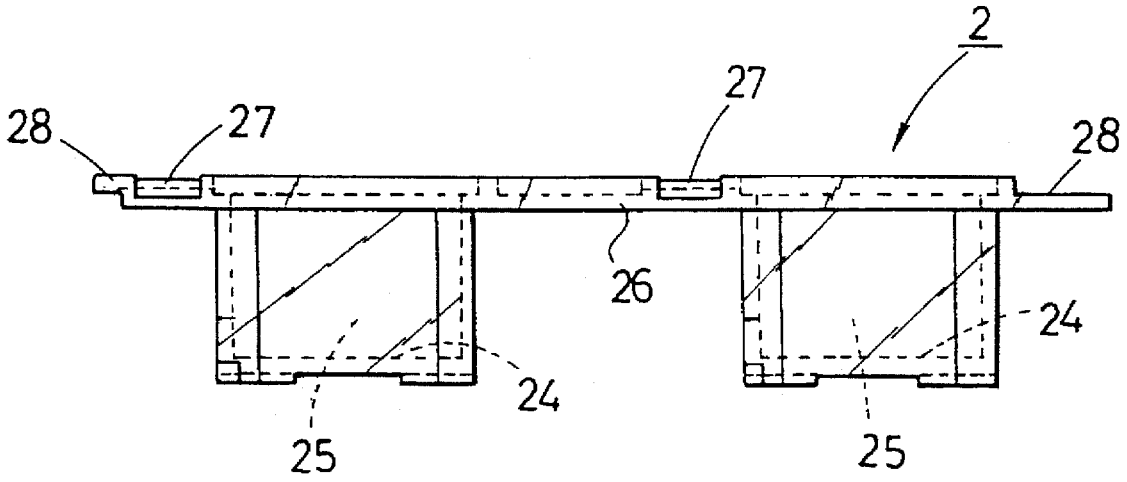
FIG. 6 is a front view of the cartridge case.

The film cartridge 3 to be held in the cartridge case 2 includes, as shown in FIG. 2, a casing 15 consisting of two separated synthetic resin members, a spool 16 rotatably mounted in the casing 15, and a cover 18 for closing a film outlet 17 to shield from external light. The cover 18 is actuated for opening and closing actions by a pivotal (operating) shaft 19 which is mounted through a side wall of the casing 15 to be driven with an opening and closing mechanism (not shown). When the cover 18 is opened, the spool 16 is rotated with one (operating) end 20 engaged across the side wall of the casing 15 with and driven by a rotating mechanism (not shown) for loading and unloading the film 5.

The casing 15 of the cartridge 3 has an ID bearing region 23 on the outer surface thereof for indicating an identification number of the cartridge 3. Also, a display window 22 is provided in the side wall of the casing 15 where the operating end 20 of the spool 16 is exposed and for displaying either unused or used condition of the cartridge 3, state of the development, presence or absence of the available frames, etc.

The cartridge case 2 for holding a group of the film cartridges 3 is illustrated in more details in FIGS. 3 to 6.

The cartridge case 2 holds and carries the film cartridges 3 from the unloading station 4 to the loading station 13 and comprises a pair of left and right 5-cartridge containers 25 joined to each other by a link plate 26, each container 25 having five bottoms 24 thereof arranged to hold the five cartridges 3 of FIG. 2 respectively in a row aligned with the moving direction.

A rack or conveyor element 27 for engagement with a cartridge conveying means described later (not shown in FIGS. 3 to 6) is provided on one side of each of the two, left and right, cartridge containers 25. Also, two flanges 28 are provided on the outer side of their respective cartridge containers 25, extending in the moving direction W of the cartridge case 2. One of the two flanges 28 on the left of the moving direction W of the cartridge case 2 has a plurality of V-shaped (positioning) notches 30 provided in an outer edge thereof for positioning the cartridge case 2 in relation to each cartridge container 25. The other flange 28 has a plurality of slit detection elements 31 provided in an outer edge thereof indicative of the cartridge case 2 being positioned in relation to the cartridge container 25.

Each of the bottoms 24 of the cartridge containers 25 which are aligned in two rows between the flanges 28 and leveled lower than the transfer elements 27 has a readout window 33 for viewing the ID bearing region 23 of the film cartridge 3 held in the container 25 and a through aperture 34 for passing the film sheet 5 unloaded from or loaded into its cartridge 3 through the film outlet 17. Also, the bottom 24 of the cartridge container 25 is provided at one side with a vertically extending holddown means 36 for pressing down with its lower semicircular portion 35 the casing 15 of the film cartridge 3 thus to hold the cartridge 3 at a specific position, and at the other side with a spool actuating hole 37 through which the operating end 20 of the spool 16 in the cartridge 3 is engaged with and actuated by the rotating mechanism for loading and unloading the film 5 and a cover actuating hole 38 through which the pivotal shaft 19 of the cover 18 is actuated by the unshown mechanism for opening and closing the film outlet 17 of the cartridge 3.

Figure 7:
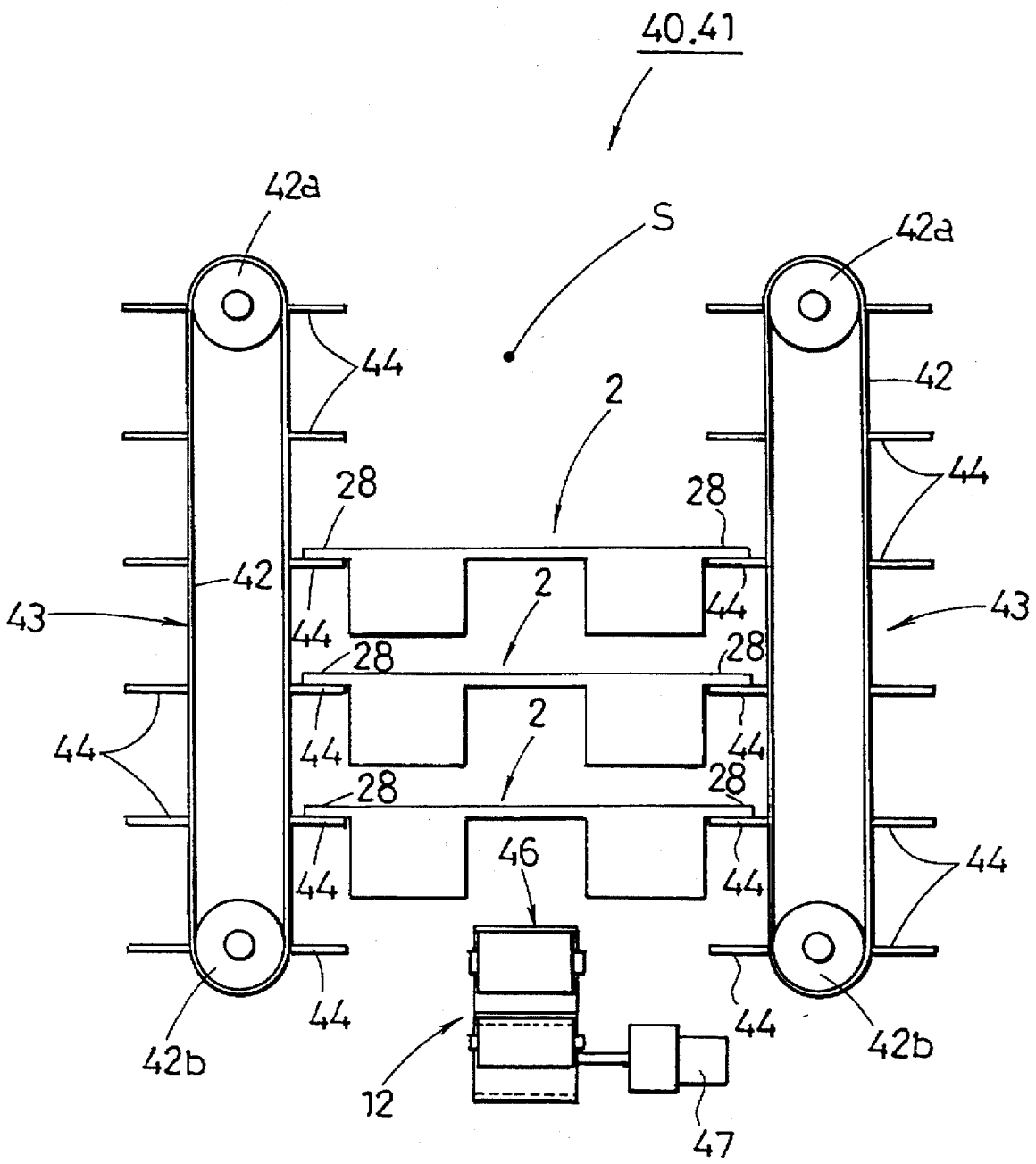
FIG. 7 is a front view of a stocker apparatus holding the cartridge cases.
Figure 8:
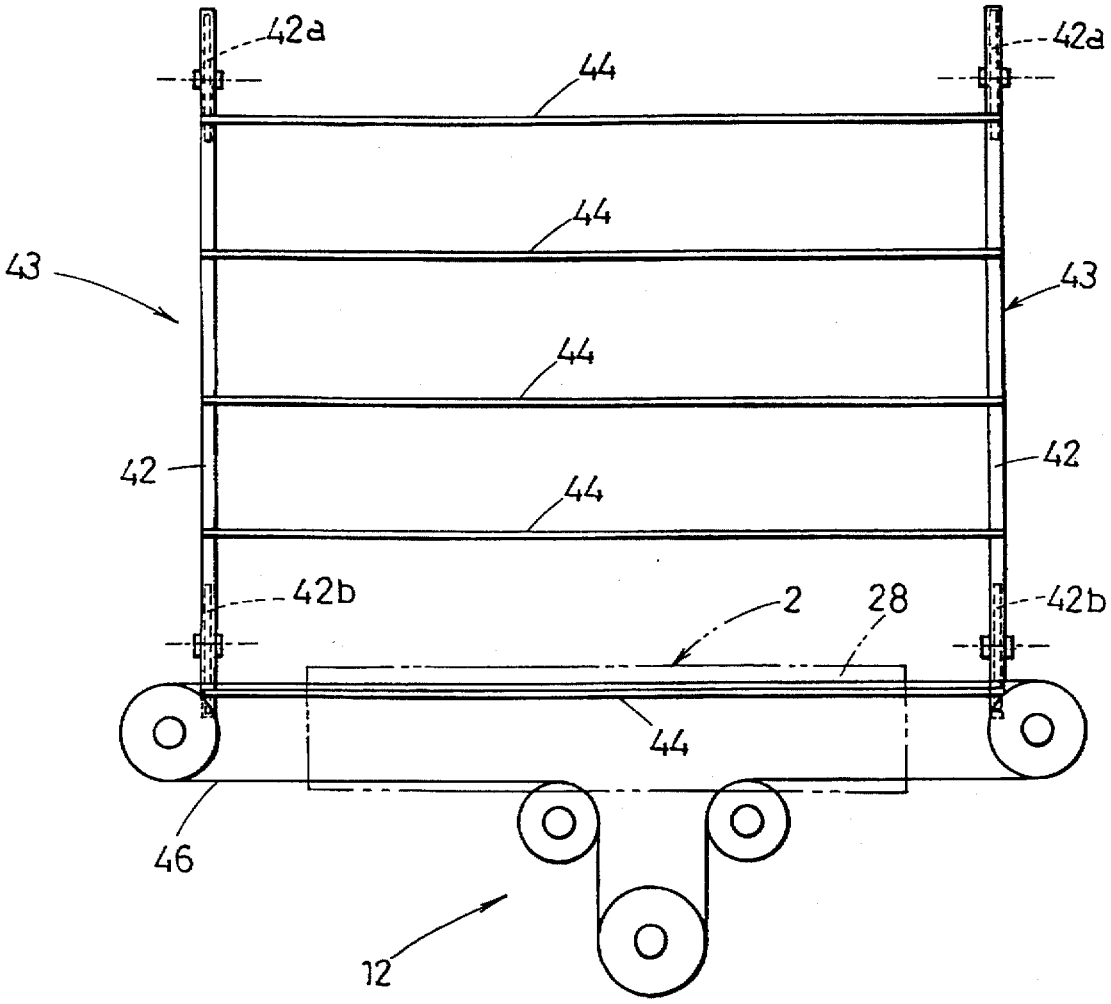
FIG. 8 is a longitudinally cross sectional view of the stocker apparatus for the cartridge cases.

The stocker apparatus 40 or 41 shown in FIGS. 7 and 8, located at either the unloading station 4 where an undeveloped film sheet 5 is unloaded from its cartridge 3 or the loading station 13 where a developed film sheet 5 is loaded into the cartridge 3 includes two pairs of upper and lower sprockets **42*a* and 42*b* which are driven at least the upper or lower sprockets by a drive device (not shown) having a motor controlled synchronous with the processing speed of the automatic film development processor machine 1. A looped chain 42 is mounted between the two sprockets 42*a* and 42*b* as acting as a lifting member 43. Two of the lifting members 43 are arranged on both, left and right, sides respectively and have a plurality of corresponding support plates 44 mounted thereto for supporting the cartridge cases 2** with pairs.

More particularly, the two lifting members 43 provided with the support plates 44 are disposed opposite to each other for having an interspace S where the cartridge cases 2 are inserted and held. The two corresponding support plates 44 support and hold in a combination the flanges 28 of the cartridge case 2.

When the two looped chains 42 are driven in forward and backward directions by the unshown drive device of the stocker apparatus 40 or 41, their associated support plates 44 lift up and down the cartridge cases 2 thereon.

Provided beneath and between the two looped chains 42 is a cartridge case conveying means 12 which comprises a conveyor belt 46 arranged extending between the unloading station 4 and the loading station 13 for conveying the cartridge cases 2 in a succession from the unloading station 4 to the loading station 13 while engaging with their link plates 26, and a motor 47 for driving the conveyor belt 46.

For starting the operation of the automatic film development processor machine, a desired number of the film cartridges 3 loaded with undeveloped films 5 are installed by an operator in the cartridge containers 25 of each cartridge case 2.

When rows of the film cartridges 3 are correctly placed in the cartridge containers 25 of the cartridge case 2 and secured with the holddown portions 35 of the same respectively, the operating end 20 of each spool 16 is aligned with the spool actuating hole 37 of the cartridge container 25, the film outlet 17 with the through aperture 34, and the pivotal shaft 19 of each cover 18 with the cover actuating hole 38. Simultaneously, the ID bearing region 23 of each cartridge 3 is located so as to be viewed through the readout window 33.

The film cartridges 3 in the cartridge case 2 are transferred in a succession to the unloading station 4 where an undeveloped film sheet 5 is unloaded from its cartridge 3 and delivered by an unshown transfer mechanism to the rewinding station 6 for rewinding into the takeup cartridge 7.

While the cartridge case 2 is positioned in the unloading station 4, the V-shaped notches 30 of its flange 28 come in engagement with correspondingly shaped projections provided on the rewinding station 6 (not shown) and the slit detection elements 31 of its other flange 28 are detected to confirm the engagement of the V-shaped notches 30 with correspondingly shaped projections. In response to the detection of the slit detection elements 31, the cover 18 of the film outlet 17 of the cartridge 3 is opened by the cover actuating mechanism coupling across the through hole 38 and turning the pivotal shaft 19.

Also, the spool 16 is rotated as its operating end 20 is engaged through the spool actuating hole 37 with the spool actuating mechanism so that the undeveloped film sheet 5 is unloaded from its cartridge 3.

The undeveloped film sheet 5 is then rewound into the takeup cartridge 7 when its trailing end has been detached from the spool 16 of the cartridge 3 by an automatic detaching device not shown. During the rewinding, the ID bearing region 23 of the cartridge 3 is read out and recorded on a controller (not shown) and the trailing end of the undeveloped film sheet 5 by a recording means such as a magnetic head.

When the undeveloped film sheet 5 unloaded from the cartridge 3 has been rewound, the V-shaped notches 30 of the cartridge case 2 are disengaged from the corresponding projections. This is followed by advancing the cartridge case 2 one step to unload and rewind an undeveloped film sheet 5 of the succeeding film cartridge 3. The undeveloped film sheets 5 of all the film cartridges 3 in the cartridge case 2 are unloaded and rewound in a succession by repeating the above procedure.

As the film cartridges 3 carry no undeveloped films, the link plate 26 of the cartridge case 2 is placed on the conveyor belt 46 of the cartridge conveying means 12.

The cartridge case 2 having the empty film cartridges 3 are conveyed by the loop movement of the conveyor belt 46 from the unloading station 4 towards the loading station 13, and the succeeding cartridge case 2 carrying another group of the film cartridges 3 loaded with the undeveloped film sheets 5 is delivered by the action of the endless belts 42 to the unloading station 4. The undeveloped film sheets 5 in their respective cartridges 3 on the succeeding cartridge case 2 are then unloaded and rewound into corresponding takeup cartridges 7 in a succession.

Meanwhile, the trailing end of the undeveloped film sheet 5 rewound in the takeup cartridge 7 is joined to the short leader 9 by the splicer device 8 and then drawn out from the takeup cartridge 7 with the short leader 9 being pulled for subjecting to the development, bleaching, fixing, drying, and other known processes. After the processes are completed, the developed film sheet 5 is separated from its short leader 9 by the separator device 11.

The cartridge case 2 at the loading station 13 is secured in position with the V-shaped notches 30 of its flange 28 engaged with corresponding projections, not shown, by a manner substantially equal to the manner at the unloading station 4. Upon the slit detection elements 31 of the other flange 28 of the cartridge case 2 being detected, the pivotal shaft 19 of the cover 18 of each film cartridge 3 is linked across the through hole 38 and actuated by the cover actuating mechanism for opening the film outlet 17.

The developed film sheet 5 separated from the short leader 9 is identified by reading and comparing its ID record with the ID data of the ID bearing region 23 on the film cartridge 3, and loaded back with its end (or trailing end of the undeveloped film form) through the film outlet 17 onto the spool 16 of the film cartridge 3.

The operating end 20 of the spool 26 is then linked across the spool actuating hole 37 and rotated by the spool actuating mechanism for taking up the developed film sheet 5 in its cartridge 3.

When all the film cartridges 3 in the cartridge case 2 have been loaded again with their respective developed film sheets 5, its V-shaped notches 30 are disengaged from the corresponding projections and the cartridge case 2 is lifted up by the stocker apparatus 41 at the loading station 13 for temporal storage.

More particularly, the stocker apparatus 41 at the loading station 13 holds the two flanges 28 of the cartridge case 2 with its support plates 44 and lifts up it for storage above the loading station 13. When the stocker apparatus 41 is filled with a desired number of the cartridge cases 2 by repeating the above movement, the cartridge cases 2 are removed at once.

A supply of the cartridge cases 2 to the stocker apparatus 40 at the unloading station 4 and a removal of the cartridge cases 2 from the stocker apparatus 41 at the loading station 13 can be executed periodically and simultaneously.

What is claimed is:

1. A cartridge case stocker apparatus for use in an automatic film development processor machine comprising:

a pair of lifting devices movably arranged opposite to each other to have a space therebetween for detachably storing a number of cartridge cases and driven by a drive device; and rows of support plates mounted at substantially equal intervals to the lifting devices for engaging with and holding the two edges of each cartridge case with a corresponding pair of support plates.

2. A cartridge case stocker apparatus for use in an automatic film development processor machine according to claim 1, wherein the drive device is arranged for forward and backward movements so that the cartridge cases held with the support plates of the two opposite lifting devices can be lifted up and down for temporal storage.

3. A cartridge case stocker apparatus for use in an automatic film development processor machine according to claim 1, further comprising a cartridge case conveying means disposed beneath the lifting devices thus to cooperate partially with the lifting devices for transferring the cartridge cases between the cartridge case conveying means and the lifting devices.

4. A cartridge case stocker apparatus for use in an automatic film development processor machine according to claim 2, further comprising a cartridge case conveying means disposed beneath the lifting devices thus to cooperate partially with the lifting devices for transferring the cartridge cases between the cartridge case conveying means and the lifting devices.

* * * * *